US008950476B2

(12) United States Patent
Head

(10) Patent No.: US 8,950,476 B2
(45) Date of Patent: Feb. 10, 2015

(54) COILED TUBING DEPLOYED ESP

(75) Inventor: Philip Head, Egham (GB)

(73) Assignee: Accessesp UK Limited, Surrey (GB)

( * ) Notice: Subject to any disclaimer, the term of this patent is extended or adjusted under 35 U.S.C. 154(b) by 683 days.

(21) Appl. No.: 13/040,819

(22) Filed: Mar. 4, 2011

(65) Prior Publication Data

US 2012/0222856 A1 Sep. 6, 2012

(51) Int. Cl.

| | |
|---|---|
| ***E21B 43/00*** | (2006.01) |
| ***E21B 4/04*** | (2006.01) |
| ***F04B 47/06*** | (2006.01) |

(52) U.S. Cl.

CPC ..... *F04B 47/06* (2013.01)
USPC ..... 166/105; 166/372; 166/66.4

(58) Field of Classification Search

CPC ..... E21B 43/128; E21B 43/121; E21B 43/38
USPC ..... 166/105, 106, 101, 372, 66.4, 385, 77.2
See application file for complete search history.

(56) References Cited

U.S. PATENT DOCUMENTS

| | | | | |
|---|---|---|---|---|
| 3,100,531 | A * | 8/1963 | Brown | 166/114 |
| 3,934,648 | A | 1/1976 | Amancharla | |
| 4,222,438 | A * | 9/1980 | Hollingsworth et al. | 166/264 |
| 4,387,767 | A | 6/1983 | Read | |
| 4,396,230 | A * | 8/1983 | Wood et al. | 299/4 |
| 4,612,984 | A * | 9/1986 | Crawford | 166/77.2 |
| 4,625,799 | A * | 12/1986 | McCormick et al. | 166/223 |
| 4,690,218 | A * | 9/1987 | Sumner | 166/297 |
| 4,898,244 | A * | 2/1990 | Schneider et al. | 166/297 |
| 5,070,941 | A * | 12/1991 | Kilgore | 166/98 |
| 5,289,881 | A | 3/1994 | Schuh | |
| 5,657,821 | A * | 8/1997 | Beauquin et al. | 166/68 |
| 6,325,143 | B1 * | 12/2001 | Scarsdale | 166/54.1 |
| 6,328,111 | B1 * | 12/2001 | Bearden et al. | 166/381 |
| 6,508,308 | B1 * | 1/2003 | Shaw | 166/313 |
| 6,755,244 | B1 * | 6/2004 | Koopmans | 166/70 |
| 6,827,147 | B2 * | 12/2004 | Dallas | 166/379 |
| 6,932,160 | B2 * | 8/2005 | Murray et al. | 166/369 |
| 7,048,057 | B2 * | 5/2006 | Bearden et al. | 166/313 |
| 7,231,978 | B2 * | 6/2007 | Rivas et al. | 166/297 |
| 8,037,941 | B2 * | 10/2011 | Quinlan | 166/386 |
| 8,397,808 | B2 * | 3/2013 | Khomynets | 166/250.01 |
| 2006/0175059 | A1 * | 8/2006 | Sinclair et al. | 166/283 |
| 2007/0181308 | A1 * | 8/2007 | Jelsma | 166/313 |
| 2007/0227742 | A1 * | 10/2007 | Dallas | 166/380 |
| 2008/0041596 | A1 * | 2/2008 | Blount et al. | 166/380 |
| 2009/0277623 | A1 | 11/2009 | Quinlan | |

FOREIGN PATENT DOCUMENTS

| | | |
|---|---|---|
| GB | 2230287 | 8/1989 |
| GB | 2347156 | 2/2000 |
| GB | 2477909 | 5/2012 |

* cited by examiner

*Primary Examiner* — Kenneth L Thompson
*Assistant Examiner* — Michael Wills, III
(74) *Attorney, Agent, or Firm* — Greenberg Traurig LLP

(57) ABSTRACT

According to the present invention, there is provided a well pumping system comprising a length of coiled tubing extending to the surface of the well, a first electric pump, a first electric motor, and a sealing means that seals against the side of the well. The sealing means include a first fluid path through which coiled tubing is in fluid communication with the well beneath the sealing means, and a second fluid path through which first electric pump is in fluid communication with the well beneath the sealing means.

14 Claims, 4 Drawing Sheets

32
55
58
20

26
32
22
20

32
22
Motor
20
Protector
Pump
24
45
26
72
27

58
Motor
55
Protector
71
53
Pump 1
54
57
46
59
32
Motor
20
Protector
Pump 2
42
27

COILED TUBING DEPLOYED ESP

This invention relates to Electric Submersible Pumps that can be deployed on a length of coiled tubing.

BACKGROUND

Electrical submersible pumps are commonly used in oil and gas wells for producing large volumes of production fluid. An electrical submersible pump (hereinafter referred to "ESP") normally has a centrifugal pump with a large number of stages of impellers and diffusers. The pump is driven by a downhole motor, which is a large three-phase motor. A seal section separates the motor from the pump to equalise the internal pressure of lubricant within the motor to the pressure of the well bore. Often, additional components will be included, such as a gas separator, a sand separator and a pressure and temperature measuring module.

An ESP is normally installed by securing it to a string of production tubing and lowering the ESP assembly into the well. Production tubing is made up of sections of pipe, each being about 30 feet in length. The well will be 'dead', that is not be capable of flowing under its own pressure, while the pump and tubing are lowered into the well. To prevent the possibility of a blowout, a kill fluid may be loaded in the well, the kill fluid having a weight that provides a hydrostatic pressure significantly greater than that of the formation pressure.

In normal operations it is desirable to access the reservoir below the ESP to perform a production log to determine where the different fluids are flowing from and perform treatments using coiled tubing to either stimulate a section of reservoir or seal a section of the reservoir producing too much water.

Coiled tubing has been used for a number of years for deploying various tools in wells, including wells that are live. A pressure controller, often referred to as a stripper and blowout preventer, is mounted at the upper end of the well to seal around the coiled tubing while the coiled tubing is moving into or out of the well. The coiled tubing comprises steel tubing that wraps around a large reel. An injector grips the coiled tubing and forces it from the reel into the well.

SUMMARY

It is an objective of this invention to be able to provide an electric submersible pump banded to the coiled tubing and lowered into a well.

Another objective is to be able to access the well below the ESP via the bore of the coiled tubing while the ESP is running.

Another objective is to have a conventional sub surface safety valve in the ESP discharge flow path Another objective is to have multi barriers in the coiled tubing to ensure it does not provide a leak path to surface.

Another objective is to install two pumps in parallel to either double the production capability of the well or provide redundancy According to the present invention, there is provided a well pumping system comprising

- a length of coiled tubing extending to the surface of the well
- a first electric pump and a first electric motor
- a sealing means that seals against the side of the well
- the sealing means wherein the sealing means include a first fluid path through which coiled tubing is in fluid communication with the well beneath the sealing means, and
- a second fluid path through which first electric pump is in fluid communication with the well beneath the sealing means.

BRIEF DESCRIPTION OF THE DRAWINGS

The following figures will be used to describe embodiments of the invention.

DETAILED DESCRIPTION

Figure 1:
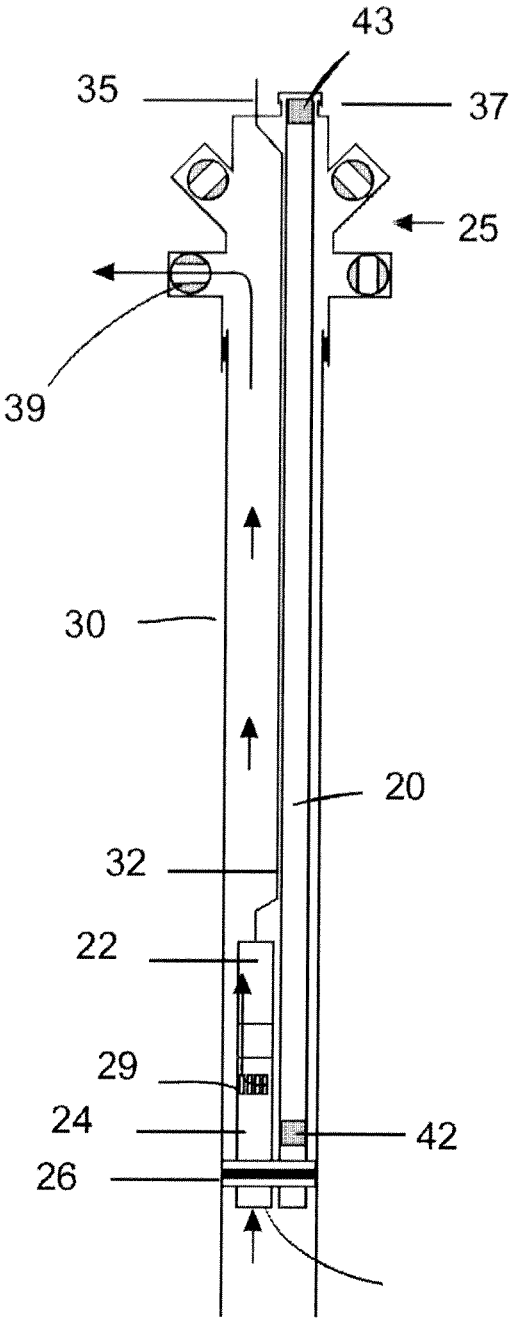
FIG. 1 is a side view of the well from surface to total depth, showing the ESP relative to the coiled tubing, well tubing, wellhead and wiring.

Referring to FIG. 1, the ESP system comprises an electric motor 22 and electric pump 24 suspended on a length of coiled tubing 20 which extends down a well tubing 30, hanging from a well head 25. The end of the coiled tubing 20 and the electric pump 24 terminate in a stinger 26.

In order to install the ESP system, electric motor 22, electric pump 24 are secured to the coiled tubing 20, and stinger 26 is secured to the ends of the electric pump 24 and coiled tubing 20, and the whole system is lowered down the well tubing 30 on the coiled tubing until the stinger 26 abuts against a locating profile 45. As the system is lowered, a power cable 32 supplying the motor is banded to the coiled tubing and is terminated in a wellhead in a conventional manor. When the stinger 26 has located in the well tubing, the top of the coiled tubing is secured on a tubing hanger in the Christmas tree upper flange 37.

The stinger 26 includes a sealing means 72 which seals against the well tubing 30. The stinger also features a double bore through which the coiled tubing 20 and the inlet 27 of the pump 24 extend through into the reservoir beneath the stinger. The coiled tubing includes upper and lower seals 43, 42 which block its inner bore. As will be described in more detail later, these seals may be removable.

Once the stinger 26 has engaged with the locating profile 45, the electric motor 22 and electric pump 24 may be activated to pump well bore fluids from the reservoir beneath the stinger up through the inside of the well tubing 30 above the stinger and the outside of the coiled tubing 20 to the wellhead to exit through a side port 39 of the Christmas tree.

Figure 2:
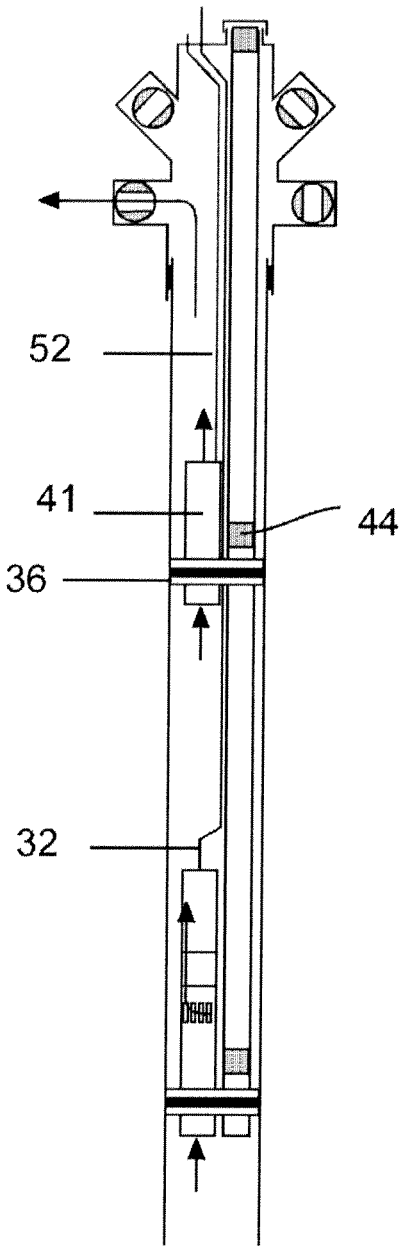
FIG. 2 is a side view of the well from surface to total depth, showing the ESP relative to the coiled tubing, well tubing, wellhead and wiring, and in addition the inclusion of a sub surface safety valve in the downstream path from the ESP

Referring to FIG. 2, the ESP system may also include a sub-surface safety valve (SSSV). In this embodiment, an SSSV 41 is attached to the coiled tubing 20 at an intermediate region of the ESP system, by a packer 36. In a similar manner to the stinger 26, the packer 36 seals against the well tubing 30, and has two bores, one of which the coiled tubing 20 extends through, and one of which the SSSV extends through. The packer 36 also has an electrical feedthrough for the power cable 32, 35. The SSSV 41 is controlled via a SSSV control line 52 which exits the wellhead, for example through its own bulkhead. An additional seal 44 is provided in the coiled tubing 20 in the region of the SSSV. In a similar way as previously described, production fluid may be pumped through the pump inlet 27 from beneath the stringer 26, through the pump 24 out of the outlet 29, up the well bore to the packer, through the SSSV 41, and out through the side port 39. Where an emergency where the well has to be closed off, for example where the surface production facilities fail, the SSSV may be activated so that the well bore is closed off.

Figure 9:
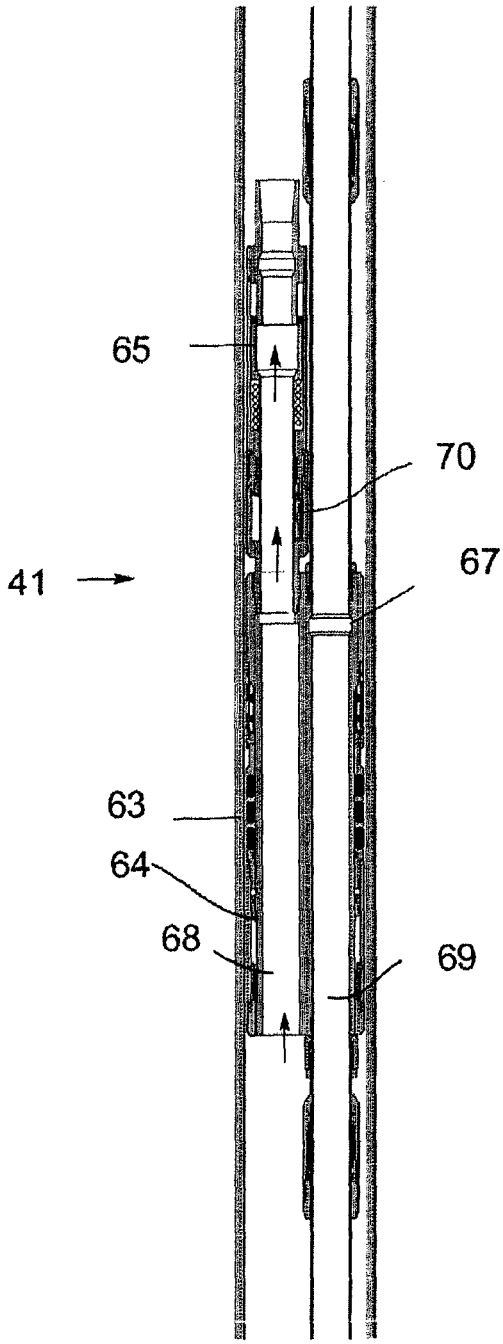
FIG. 9 is a side view of the coiled tubing and sub surface safety valve arrangement situated at a suitable depth below surface.

The SSSV 41 is shown in more detail in FIG. 9. The SSSV 41 has a packer portion 64 has a first bore 68 which constrains fluid communication in the well tubing 30 (not including the separate fluid path of the coiled tubing 20) through the safety valve means 65, and a second bore 69 through which the fluid path of the coiled tubing 20 passes. Rubber packing elements 63 seal the packer 64 against the side of the well tubing 30. When the valve means 65 is activated, the fluid path through the well tubing 30 by the flapper valve 70 (not including the coiled tubing 20) is blocked. This figure also shows a profile 67 into which the seal 44 is located; the other seals 42, 43, 46 may be located in similar profiles.

Figure 3:
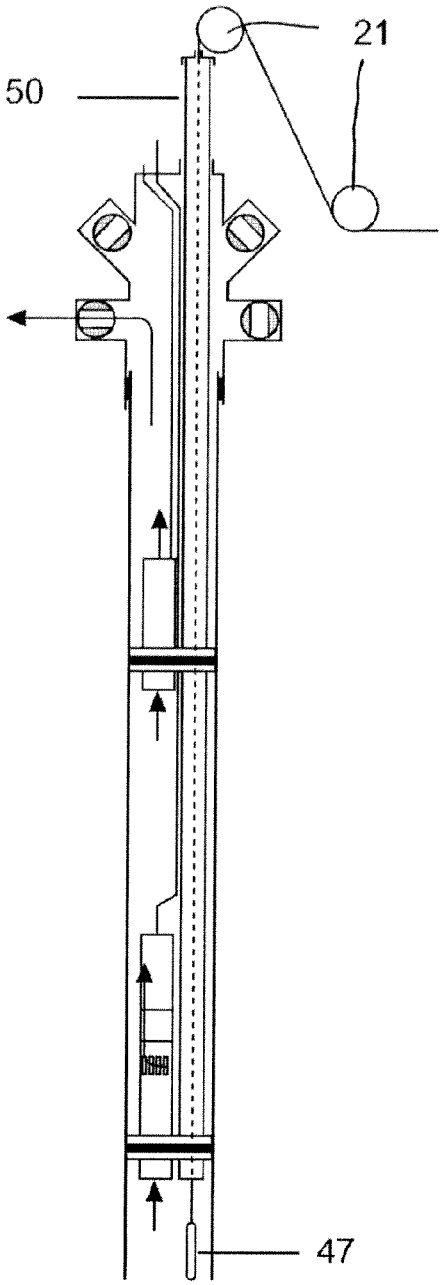
FIG. 3 is a similar view to FIG. 2 with the reservoir being accessed below the ESP by a wireline logging tool via the inside of the coiled tubing.

Referring to FIG. 3, tools such as a logging tool 47 may be run down the well through the coiled tubing 20. To insert the tool 47, a lubricator 50 is attached to the coiled tubing port, and the tool 47 lowered through the coiled tubing whilst attached to a wireline paid out from reel (not shown) over pulleys 21. The seals 42, 43, 44 in the coiled tubing are removed in some manner, for example by retrieval through the coiled tubing 20 from the surface using a GS fishing tool. The tool 47 is then lowered past the end of the coiled tubing 20 as far as desired. The tool 47 may be winched up and removed from the well simply by reversing the operation. The seals 42, 43, 44 (or replacement seals) are then lowered or dropped down the coiled tubing 20 to their original position. Production fluid may still be pumped through the ESP system during the installation of the tool 47 in the well.

Figure 4:
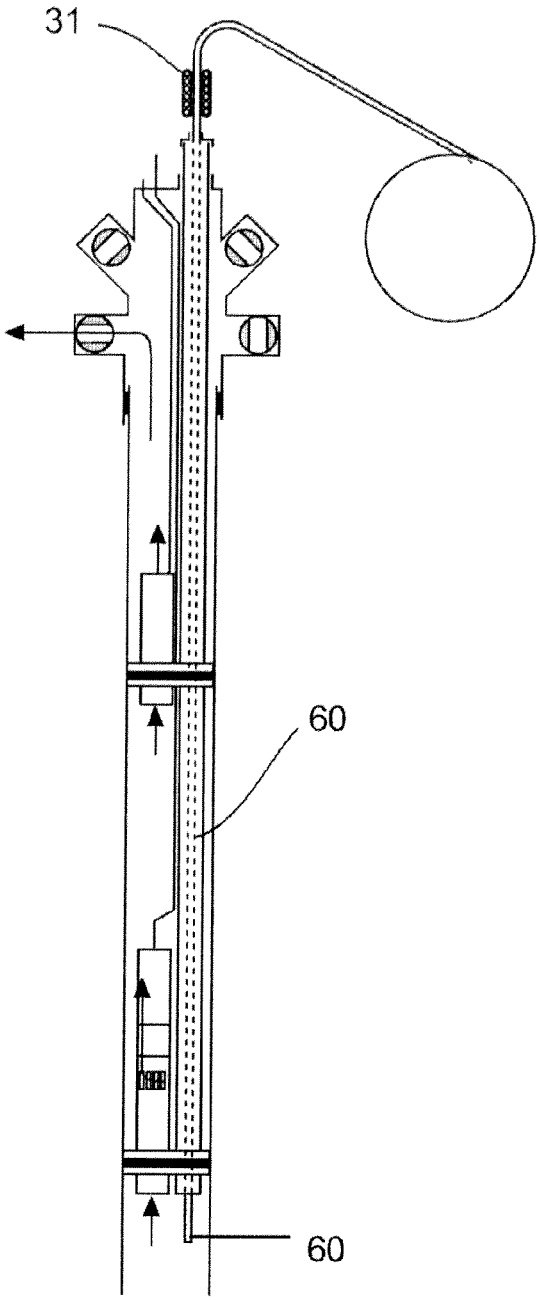
FIG. 4 is a similar view to FIG. 2 with the reservoir being accessed below the ESP by a coiled tubing work string via the inside of the coiled tubing.

Referring to FIG. 4, a second length of coiled tubing 60, having a smaller diameter than the bore of the coiled tubing 20, may be introduced into the coiled tubing 20 through the coiled tubing port 37 using a coiled tubing injector 31. As for the previous example, the seals 42, 43, 44 are removed before or during the introduction of the second coiled tubing 60 through the first coiled tubing 20. The second length of coiled tubing may extended down through the end of the coiled tubing 20 to a lower part of the well. The coiled tubing 60 may for example be used to inject fluid or gas at a lower part of the well. The coiled tubing 60 may of course be removed from the well simply by reversing the operation. As for the previous example, the seals 42, 43, 44 in coiled tubing 20 may be replaced by various known methods.

Figures 5, 6, 7, 8:
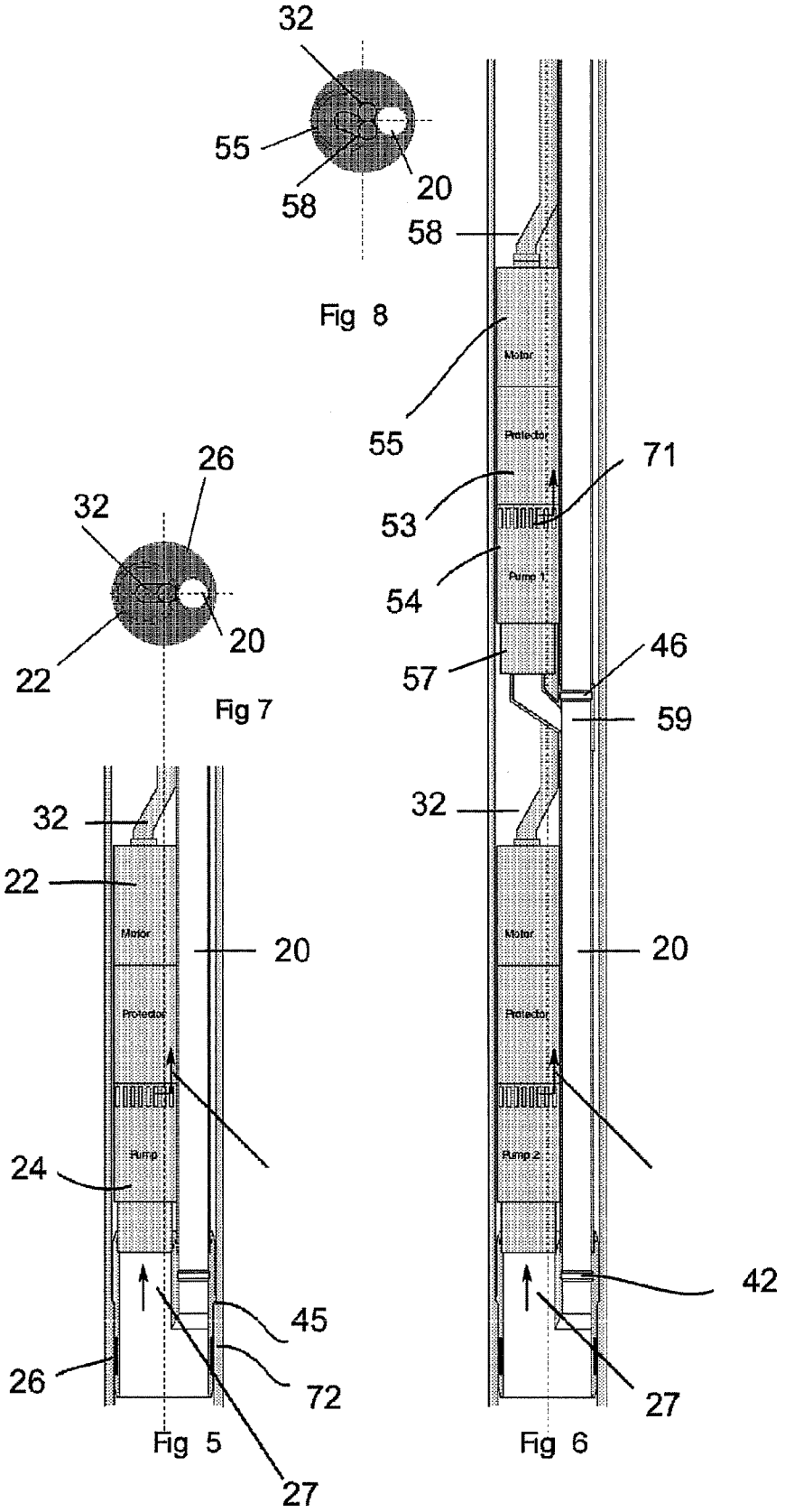
FIG. 5 is a side view of the ESP handed to the coiled tubing
FIG. 6 is a side view of a two ESP installation, one stacked on top of the other each having individual inlets from the reservoir and a common discharge into the production tubing surrounding the ESP's and external to the coiled tubing.
FIG. 7 is a plan view of the single ESP installation of FIG. 5.
FIG. 8 is a plan view of the tandem ESP installation of FIG. 6.

Referring now to FIG. 6, a second electric motor 55, motor protector 53 and electric pump 54 may be included in the ESP system. In this embodiment, the inlet 57 of the pump 54 ports onto the side of the coiled tubing 20 through a Y-tool 59. An additional retrievable seal 46 is included in the coiled tubing 20, immediately above where the second pump 54 ports onto the coiled tubing 20. The electric motor 55, and electric pump 54 are powered by a second power cable 58. If an SSSV is included, the power cable 58 extends through an electrical feedthrough together with power cable 32.

In normal use, this embodiment may be operated as for the previously described embodiments, with well fluid being drawn through the pump 24, and up through the well to the surface, whilst the coiled tubing 20 may have its seals 42, 43, 44, 46 removed so that tools 47 or smaller diameter coiled tubing 60 may be run down the coiled tubing 20. However, should a fault develop with the pump 24 or motor 22 which prevents the pump 24 from drawing well fluid, the seal 42 may be removed from the coiled tubing (which may involve removal and replacement of seals 43, 44, and 46) and second motor 55 activated so that the pump 54 draws well fluid through the end of the coiled tubing 20, past the stinger 26, into the pump 54 via the Y-tool 59, out of the pump outlet 71 and up through the well and out of the side port 39.

The invention claimed is:

1. A well pumping system comprising:

a substantially straight length of coiled tubing extending generally vertically between an upper end at a surface of a well and a lower end;

a first electric pump and a first electric motor;

a sealing means that seals against a side of the well above the lower end of the coiled tubing;

the sealing means including a first fluid path through which the coiled tubing is in fluid communication with the well beneath the sealing means, and a second fluid path through which first electric pump extends above and below the sealing means and is in fluid communication with the well beneath the sealing means;

the coiled tubing allowing passage of a tool through the coiled tubing past the lower end of the coiled tubing below the electrical submersible pump while the tool is attached to a wireline past the lower end of the coiled tubing below the electrical submersible pump; and a valve means including a packer portion, the valve means being disposed above the sealing means and the electric motor and electric pump but beneath the surface of the well, wherein the valve means can be activated to provide a seal against the side of the well and an outer surface of the coiled tube.

2. A well pumping system according to claim 1 wherein first electric pump and/or first electric motor are secured to the coiled tubing prior to deployment down the well.

3. A well pumping system according to claim 2 wherein the sealing means is secured to the first electric pump and coiled tubing prior to deployment down the well.

4. A well pumping system according to claim 2 wherein there is included a second electric pump and a second electric motor, the second electric pump being in fluid communication with the coiled tubing.

5. A well pumping system according to claim 1 wherein the sealing means is secured to the first electric pump and coiled tubing prior to deployment down the well.

6. A well pumping system according to claim 5 wherein there is included a second electric pump and a second electric motor, the second electric pump being in fluid communication with the coiled tubing.

7. A well pumping system according to claim 1 wherein there is included a second electric pump and a second electric motor, the second electric pump being in fluid communication with the coiled tubing.

8. A well pumping system according to claim 1 wherein the tool is a logging tool.

9. A method for installing a tool in a well, the method comprising:

providing a coiled tubing extending down a well tubing hanging from a wellhead with an upper end of the coiled tubing providing a tubing port and a lower end of the coiled tubing terminating in a stinger below or adjacent an electrical submersible pump;

attaching a lubricator to the tubing port; and lowering a tool through the coiled tubing while the tool is attached to a wireline past the lower end of the coiled tubing below the electrical submersible pump.

10. The method of claim 9, further comprising removing at least one seal from the coiled tubing through the upper end of the coiled tubing prior to lowering the tool through the coiled tubing.

11. The method of claim 10, further comprising lowering or dropping the at least one seal or at least one replacement seal through the upper end of the coiled tubing to an original seal location after lowering the tool through the coiled tubing.

12. The method of claim 9, further comprising pumping production fluid through the electrical submersible pump during installation of the tool in the well.

13. The method of claim 9, further comprising winching the tool upward through the coiled tubing and removing the tool through the upper end of the coiled tubing.

14. The method of claim 9, wherein the tool is a logging tool.

* * * * *